United States Patent [19]

Ando

[11] 4,352,580

[45] Oct. 5, 1982

[54] KNOCK-OUT TYPE MECHANICAL PENCIL WITH RETRACTABLE ERASER

[75] Inventor: Yoichi Ando, Yokohama, Japan

[73] Assignee: Mitsubishi Pencil Co., Ltd., Tokyo, Japan

[21] Appl. No.: 201,243

[22] Filed: Oct. 27, 1980

[30] Foreign Application Priority Data

Oct. 29, 1979 [JP] Japan ..... 54-148875

[51] Int. Cl.[3] ..... B43K 29/02

[52] U.S. Cl. ..... 401/29; 15/429; 15/431; 15/433; 15/434; 401/31; 401/52; 401/82; 401/99; 401/100; 401/115

[58] Field of Search ..... 15/427, 428, 429–434; 401/100, 115, 29, 31, 52, 82, 99

[56] References Cited

U.S. PATENT DOCUMENTS 2,132,643 10/1938 Pestel ..... 15/432
4,176,979 12/1979 Saida ..... 401/100

FOREIGN PATENT DOCUMENTS 71231 10/1959 France ..... 401/15
2420434 10/1979 France ..... 401/100
769740 3/1957 United Kingdom ..... 401/15
869699 6/1961 United Kingdom ..... 401/15
2041296 9/1980 United Kingdom ..... 401/115

*Primary Examiner*—Steven A. Bratlie
*Attorney, Agent, or Firm*—Andrus, Sceales, Starke & Sawall

[57] ABSTRACT

A knock-out type mechanical pencil has a supporting rod mounted with an eraser at its rear end and axially slidably engaged within the interior of a cylindrical knock-button. A tubularly cylindrical weight is axially slidably engaged around the supporting rod. A cylindrical magnet is axially magnetized and secured to the inner peripheral surface of the knock-button. An annularly inwardly raised guide portion is formed on the inner peripheral surface of the knock-button for guiding the weight to the axial line of the knock-button when the weight is axially slidably dropped downwardly toward the writing tip of the pencil. To protrude and fix an eraser from the rear end of the tubular cylindrical body, the rear end of the pencil is tilted downward. To automatically contain or retract the eraser in the knock-button, the writing tip of the pencil is directed downwardly in writing state. Thus, this mechanical pencil can stably perform an erasing operation with an eraser without any rocking motion of the eraser in axial direction nor rotation of the eraser.

4 Claims, 4 Drawing Figures

KNOCK-OUT TYPE MECHANICAL PENCIL WITH RETRACTABLE ERASER

BACKGROUND OF THE INVENTION

This invention relates to an improvement in a knock-out type mechanical pencil and, more particularly, to a knock-out type mechanical pencil which can protrude and fix an eraser from the rear end of its tubular cylindrical body merely by tilting down the rear end of the body and can also automatically contain the eraser in its knock-button by directing the writing tip of the pencil downwardly in writing state.

In a conventional knock-out type mechanical pencil, an eraser is normally mounted at a knock-button of its rear end, and a cap covers the eraser. It is accordingly necessary to remove the cap from the rear end of the pencil to use the eraser. This removing operation is disadvantageously complicated and it is easy to lose the removed cap. If the knock-out type mechanical pencil is constructed to directly knock the eraser without a cap, its appearance is spoiled, the eraser loses its erasing function and tends to be buried within the knock-button.

SUMMARY OF THE INVENTION

It is therefore an object of this invention to provide a knock-out type mechanical pencil which eliminates the aforementioned disadvantages of the conventional knock-out type mechanical pencil and can use its eraser very simply.

Another object of this invention is to provide a knock-out type mechanical pencil which can protrude its eraser from the rear end of its tubular cylindrical body and fix it to the rear end of its tubular cylindrical body merely by tilting down the rear end of the body and can also automatically retract the eraser into its knock-button by directing the writing tip of the pencil downwardly in writing state.

Yet another object of this invention is to provide a knock-out type mechanical pencil which can smoothly conduct its knocking operation and can feed a lead to its writing tip without fail.

A further object of this invention is to provide a knock-out type mechanical pencil which can feed a lead without contacting an eraser so as to present a preferable appearance.

Still another object of this invention is to provide a knock-out type mechanical pencil which can stably perform an erasing operation with an eraser without any rocking motion of the eraser in axial direction nor rotation of the eraser.

Still another object of the invention is to provide a knock-out type mechanical pencil which can readily remove an eraser without apprehension of losing the eraser or cover for the eraser or other components.

The foregoing objects and other objects as well as the characteristic features of the invention will become more apparent and more readily understandable by the following description and the appended claims when read in conjunction with the accompanying drawings.

DESCRIPTION OF THE PREFERRED EMBODIMENTS

Figure 1:
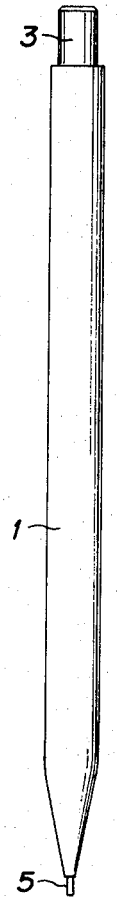
FIG. 1 is a side view of one preferred embodiment of the knock-out type mechanical pencil constructed according to this invention.
Figure 2:
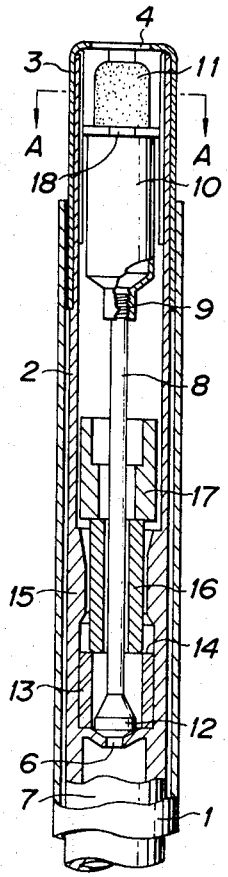
FIG. 2 is an enlarged fragmentary sectional view of the mechanical pencil of this invention.
Figure 3:
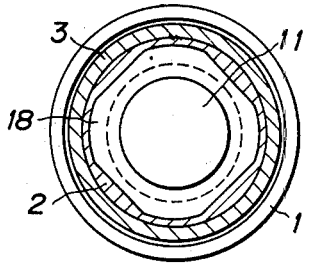
FIG. 3 is a sectional view taken along the line A—A in FIG. 2.

Reference is now made to the drawings, particularly to FIGS. 1 through 3 showing one preferred embodiment of the knock-out type mechanical pencil constructed according to this invention, wherein like reference numerals designate the same parts in the drawings and following views.

A knock-out type mechanical pencil of this invention comprises a tubular cylindrical body 1, a cylindrical knock-button 2 axially slidably inserted into the rear opening of the cylindrical body 1, and a cylindrical cover 3 axially slid on the knock-button 2 and having an eraser protruding hole 4 perforated at the top thereof. A lead 5 is slidably fed in the axial direction and is projected from the forward end or writing tip or the body 1 at a predetermined length everytime the cover 3 is knocked or depressed, as known per se in the conventional lead feeding mechanism.

The knock-button 2 has a lead inlet opening 6 formed at the bottom thereof and a lead container 7 formed in cylindrical shape axially at the forward portion from the opening 6 for containing a plurality of leads. The knock-button 2 also has a supporting rod 8 axially slidably disposed therein, which rod 8 has a male threaded portion 9 formed at its rear end and engaged with a female threaded portion formed at the bottom of a cylindrical holder 10 for fixedly holding an eraser 11, and a magnetic collar 12 formed at its front end to face opposite the opening 6 of the knock-button 2.

The knock-button 2 axially contains a tubular cylindrical magnet 13 axially magnetized at the position where the magnet 13 faces with the collar 12 therein when the eraser 11 is contained or retracted into the eraser protruding hole 4 of the cover 3. The magnet 13 is axially secured to the inner peripheral surface thereof above the bottom at one end of the knock-button 2 with an annularly stepped portion 14 formed at the other rear end. The knock-button 2 also has an annularly inwardly raised guide portion 15 formed on the inner peripheral surface thereof above the stepped portion 14 of the magnet 13. The knock-button 2 also contains axially a tubularly cylindrical weight 16 having an outer diameter slightly smaller than the inner diameter of the raised guide portion 15 axially slidable around the supporting rod 8 above the stepped portion 14 of the magnet 13, and another tubularly cylindrical weight 17 having an outer diameter slightly larger than the inner diameter of the raised guide portion 15 axially slidably around the supporting rod 8 above the cylindrical weight 16 and also having an axially cylindrical inner recess formed at the rear end thereof for receiving the female threaded portion of the holder 10 when the weight 17 is axially slidably moved to the holder 10 as the body 1 is directed with its eraser end downwardly. When the eraser 11 is thus retracted into the hole 4 of the cover 3 as the writing tip of the body 1 is directed downwardly in writing state, the weight 16 engaged around the supporting rod 8 is slidably engaged within the raised guide portion 15 of the knock-button 2 relatively tightly.

The knock-button 2 also contains, as shown in FIG. 3, a collar 18 formed around the outer periphery of the holder 10 formed in non-rotatably symmetrical shape and engaged with the inner peripheral surface of the knock-button also formed in non-rotatably symmetrical shape and slidably contacting with the outer periphery of said holder to thereby prevent the supporting rod 8 from turning therein.

The knock-out type mechanical pencil constructed above is operated as follows:

When writing with the above mechanical pencil, the front end or writing tip thereof is generally directly downwardly. Accordingly, the eraser 11 is retracted, as shown in FIG. 2, into the hole 4 of the cover 3. When the cover 3 is knocked or pushed in this state, the knock-button 2 is axially slidably moved down in FIG. 2 as known per se in the conventional mechanism to feed the lead 5 in FIG. 1. Thus, the lead 5 is fed out from the writing tip of the body 1 without manual contact with the eraser 11 in the cover 3. Since the eraser 11 is not exposed over the cover 3 in this state, the appearance of the mechanical pencil in this state is is in the preferable state.

Figure 4:
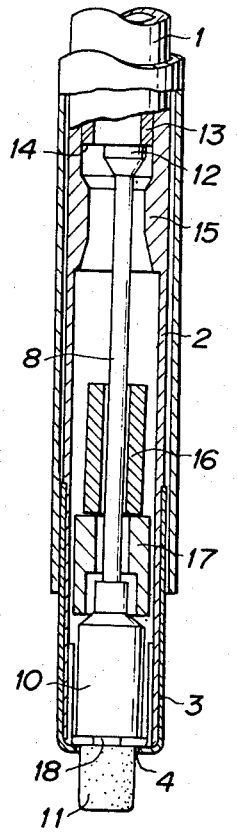
FIG. 4 is a view similar to FIG. 2 but showing the state in which the eraser is used.

When it is necessary to use the eraser 11, the rear end of the body 1 is required to be directed downwardly. When the rear end or the cover 3 of the body 1 is directed downwardly, the weights 16 and 17 are axially slidably moved or dropped, as shown in FIG. 4, toward the rear end of the body 1. Simultaneously, the supporting rod 8 is also axially slidably moved or dropped toward the rear end of the body 1. Thus, the eraser 11 is axially slidably protruded from the hole 4 outwardly of the cover 3. Accordingly, the magnetic collar 12 of the supporting rod 8 is moved out of the interior of the magnet 13 and is accordingly engaged with the stepped portion 14.

The engagement of the threaded portion 9 of the supporting rod 8 with the threaded portion of the holder 10 is adjusted in advance so that the collar 18 may be engaged with the edge of the cover 3 in such a manner that the eraser 11 is so fixed as amost not to rock axially of the body 1. Accordingly, desired letter may be erased on paper by slidably moving the eraser in contact on the paper.

It is noted that since the stepped portion 14 is formed on one end of the magnet 13, the magnetic collar 12 of the supporting rod 8 is magnetically attracted to the stepped portion 14 to thus exactly engage the collar 12 with the stepped portion 14 of the magnet 13 and to accordingly prevent completely the axial rocking motion of the eraser 11. In addition, it is also noted that since the collar 18 formed in symmetrical shape and engaged with the inner peripheral surface of the knock-button 2 around the outer periphery of the holder 10 at the rear end of the holder 10 prevents the supporting rod 8 from turning therein, there is no concern for rotating the eraser 11 when slidably erasing the eraser 11 on paper to thus result in stable performance of the erasing operation of the eraser 11.

When the front end or writing tip of the body 1 is again directed downwardly in writing state, the weight 16 and 17 are first axially slidably moved downwardly or dropped. Thus, the weight 16 is engaged with the raised guide portion 15 of the knock-button 2. When the weight 16 is thus engaged with the raised guide portion 15, the supporting rod 8 is laterally moved onto the axial line of the knock-button 2 so that the magnetic collar 12 of the supporting rod 8 is slidably inserted into the interior of the magnet 13 to return to the state shown in FIG. 2.

When the cover 3 is removed from the rear end of the body 1 and the holder 10 is then removed from the rear opening of the knock-button 2, the supporting rod 8 with the weights 16 and 17 are also removed together with the holder 10, and leads may be thus supplied through the lead inlet opening 6 of the knock-button 2 into the lead container 7 of the knock-button 2. It is noted that since the eraser 11 held in the holder 10 integrally engaged with the supporting rod 8 and the weights 16 and 17 around the rod 8 in this case, the removal of the components from the body 1 may be readily carried out and no components may be lost upon removal of the components.

It should be understood from the foregoing description that since the collar 12 of the supporting rod 8 is moved out of the tubular magnet 13 when the cover 3 of the body 1 is directed downwardly to use the eraser 11 and the weight 16 is engaged with the raised guide portion 15 of the knock-button 2 to laterally move the supporting rod 8 to the axial line of the knock-button 2 to thereby slidably insert the supporting rod 8 into the magnet 13 when the writing tip of the body 1 is directed downwardly in writing state, the knock-out type mechanical pencil may protrude the eraser from the rear end of the body and fix it to the rear end merely by tilting down the rear end of the body and can also automatically retract the eraser into the knock-button by directing the writing tip of the pencil downwardly in writing state. It should also be appreciated that since the mechanical pencil of this invention is thus constructed, it can very readily use the eraser and perform the knocking operation and the supply of the leads thereto without fail.

What is claimed is:

1. A knock-out type mechanical pencil comprising:

a tubular cylindrical body (1) invertable between a writing position and an erasing position, said body having a first end oriented downwardly when the pencil is in the writing position and a second, opposite end;

a cylindrical knock-button member (2) axially slidably inserted into said second end of said cylindrical body for feeding writing lead to said first end, said cylindrical knock-button member having an axial hole (4);

a supporting rod (8) inside said knock-button member (2) and having first and second ends (12, 9) oriented the same as said first and second ends of said body, said supporting rod (8) being axially slidably movable in said cylindrical knock-button member (2) by the inversion of said body (1);

an eraser (11) mounted on the second end (9) of said supporting rod (8) and extendable from within said knock-button member (2) through said axial hole (4) by movement of said rod (8) when said body (1) is inverted to the erasing position;

a tubular cylindrical weight (16) surrounding said supporting rod (8) and slidable therealong towards said first and second ends by the inversion of said body;

an annular, inwardly extending guide portion (15) formed on the interior of said cylindrical knock-button member (2) and surrounding said rod, said guide portion (15) being so located on said knock-button member (2) as to coact with said weight (16) when the latter is adjacent the first end (12) of said rod (8) for causing the rod (8) to be generally on the axis of said knock-button member (2), said weight (16) being free of said guide portion (15) when adjacent the second end (9) of said rod (8) to allow said first end (12) of said rod to assume a non-axial condition with respect to said cylindrical knock-button member (2);

a tubular cylindrical element (13) fixedly disposed within said knock-button member (2), said element (13) surrounding said rod (8) when said body is in the writing position, said first end (12) of said rod (8) engaging said element (13) when said rod (8) is in the non-axial condition for preventing movement of said rod towards said first end of said body;

said pencil having a cylindrical holder (10) for said eraser (11) mounted on said second end (9) of said supporting rod (8) within said knock-button member (2) and slidably contacting the interior surface of said knock-button member (2), said holder (10) and knock-button member interior surface being formed to prevent said holder (10) from turning with respect to said knock-button member (2); and an additional cylindrical weight (17) surrounding said supporting rod (8) and positioned above said tubular weight (16) when said body is in said writing position, said additional weight (17) having an outer diameter slightly larger than the inner diameter of said inwardly extending guide portion (15).

2. The knock-out type mechanical pencil according to claim 1 wherein the front end (12) of said supporting rod (8) is formed of magnetic material, and said cylindrical element (13) is made of magnetic material.

3. The knock-out type mechanical pencil according to claim 1 wherein a cylindrical cover (3) detachably mounted on said knock-button member (2) and having a hole forming said axial hole (4), wherein said eraser (11) is integrally formed with said supporting rod (8) and said cylindrical weight (16), and wherein a lead inlet opening (6) is formed at the bottom of said knock-button member (2) facing oppositely with the front end (12) of said supporting rod (8).

4. The knock-out type mechanical pencil according to claim 1 wherein said holder (10) is further defined as having a collar (18) slidably contacting the interior surface of said knock-button member (2) and formed to prevent rotation of said holder with respect to said knock-buttom member (2).

* * * * *